US012768608B2

(12) United States Patent
Valtierra

(10) Patent No.: US 12,768,608 B2
(45) Date of Patent: Oct. 20, 2026

(54) FIREARM SYSTEM WITH GAS-PISTON SYSTEM

(71) Applicant: VALT DEFENSE LLC, Middleton, WI (US)

(72) Inventor: Anthony Wright Valtierra, Middleton, WI (US)

( * ) Notice: Subject to any disclaimer, the term of this patent is extended or adjusted under 35 U.S.C. 154(b) by 0 days.

(21) Appl. No.: 18/944,909

(22) Filed: Nov. 12, 2024

(65) Prior Publication Data

US 2025/0155210 A1 May 15, 2025

Related U.S. Application Data

(60) Provisional application No. 63/599,282, filed on Nov. 15, 2023.

(51) Int. Cl.
*F41A 5/26* (2006.01)
*F41A 3/66* (2006.01)

(52) U.S. Cl.
CPC . *F41A 5/26* (2013.01); *F41A 3/66* (2013.01)

(58) Field of Classification Search
CPC ..... F41A 5/18; F41A 5/20
USPC ..... 89/191.01, 191.02, 192, 193
See application file for complete search history.

(56) References Cited

U.S. PATENT DOCUMENTS 5,272,956 A * 12/1993 Hudson ..... F41A 5/28 89/193
2005/0115398 A1 6/2005 Olson
2010/0186582 A1 7/2010 Juarez
2011/0030260 A1 2/2011 Herring
2012/0180645 A1 7/2012 Griffin
2012/0311908 A1 12/2012 Kenney et al.
2015/0330729 A1 11/2015 Adolphsen
2020/0124364 A1 4/2020 Meier
2020/0271405 A1 8/2020 Thompson

OTHER PUBLICATIONS

International Search Report and Written Opinion in PCT/US2024/055498, dated Jan. 16, 2025, 16 pages.
International Preliminary Report on Patentability—PCT/US2024/055498, issued May 8, 2026.

* cited by examiner

*Primary Examiner* — Reginald S Tillman, Jr.
(74) *Attorney, Agent, or Firm* — Barnes & Thornburg; Steven D. Shipe

(57) ABSTRACT

A firearm system includes an upper receiver and a barrel mounted to the upper receiver and configured to fire projectiles. The firearm system further includes a bolt carrier arranged within the upper receiver for reciprocation during firing. The firearm system further includes a gas-piston system for transferring firing force to the bolt carrier for reloading after each projectile is discharged from the barrel.

19 Claims, 12 Drawing Sheets

FIREARM SYSTEM WITH GAS-PISTON SYSTEM

CROSS-REFERENCE

This U.S. utility patent application claims the benefit of priority to U.S. provisional patent application No. 63/599,282, entitled "FIREARM SYSTEM WITH GAS-PISTON SYSTEM" filed on Nov. 15, 2023, the contents of which are incorporated by reference herein in their entirety.

FIELD

The present disclosure relates to devices, systems, and methodologies for firearms. More particularly, the present disclosure relates to devices, systems, and methodologies for loading systems for firearms.

Automatic (including semi-automatic) firearm systems can use firing gases to reload after discharging a projectile. Firing gases produced by discharge of propellant to drive the projectile can include waste materials, such as gases, effluents, and/or particulates that can soil and/or clog various components included in the firearm. Additionally, systems which use firing gases from projectiles can implement structures that can affect the response of the firearm to the high forces in firing. Such response effects can adversely affect accuracy and/or performance.

SUMMARY

According to one aspect of the presenting disclosure, a firearm system includes an upper receiver, a barrel mounted to the upper receiver; a bolt carrier arranged within the upper receiver for reciprocation; and a gas-piston system for transferring firing force to the bolt carrier for reloading. The gas-piston system may include a piston shroud mounted to the upper receiver and a piston connected with the bolt carrier. The piston may be arranged within the piston shroud to receive force from firing gas from the barrel for reciprocating movement. The piston may be operable between an extended position and retracted position to drive reloading via the bolt carrier.

In the illustrative embodiment, the gas-piston system is a Direct Impingement Indexed Piston System. A traditional style gas block and/or gas tube can index into a free floated piston shroud, and the gas block and/or gas tube can receive direct impingement for facilitating recoil reloading.

In some embodiments, the piston shroud may be cantilevered from the upper receiver. The piston shroud may include a gas tube receiver arranged at a free end of the piston shroud. The gas tube receiver may be configured for interfacing with a gas tube that is fluidly connected with the barrel to receive firing gas therefrom for communication into the piston shroud.

In some embodiments, the gas tube is freely received by the gas tube receiver for fluid connection between the piston shroud with the barrel to communicate firing gas without restraint of the barrel. The barrel may include a gas block extending radially therefrom for connection with the gas tube to communicate firing gas. In some embodiments, the gas tube may be arranged not to enter the upper receiver.

In some embodiments, the barrel may be configured for free-floating. The barrel may be cantilevered from the upper receiver and may be configured for communication of firing gas from the barrel to the piston shroud with freedom for independent, cantilevered barrel dynamics under firing.

In some embodiments, the piston may extend from the bolt carrier out from the upper receiver and into the piston shroud. The piston may include a piston extension arranged within the piston shroud. The piston extension may be positioned between the piston and an end of the piston shroud to receive force from firing gas to drive the piston extension for movement for transmission to the piston. In some embodiments, the piston extension may be configured for reciprocating movement within the piston shroud having close tolerancing with an inner cavity wall of the piston shroud to block against passage of firing gas beyond the piston extension.

In some embodiments, the piston extension may be formed distinctly from the piston. Each of the piston extension and piston may be arranged for reciprocating motion within the piston shroud.

In some embodiments, the piston may be formed with a low profile cross-section taken along a longitudinal direction parallel with the barrel. The cross-section may be shaped as a circular portion reduced from circular to allow reduced height-over-bore. The cross-section may be shaped as a circular segment.

In some embodiments, the piston may be formed to have a full-profile cross-section at one end for connection with the bolt carrier. The low profile cross-section may be formed on an extension portion projecting away from the bolt carrier for arrangement within the piston shroud. The firearm system may further include a lower receiver coupled with the upper receiver to form a firearm.

According to another aspect of the present disclosure, a firearm includes a receiver including an upper receiver and a lower receiver; a barrel mounted to the upper receiver; a bolt carrier arranged within the upper receiver for reciprocation; and a gas-piston system for transferring firing force to the bolt carrier for reloading. The gas-piston system may include a piston shroud mounted to the upper receiver and a piston connected with the bolt carrier. The piston may be arranged within the piston shroud to receive force from firing gas from the barrel for reciprocating movement. The piston may be operable between an extended position and retracted position to drive reloading via the bolt carrier.

According to another aspect of the present disclosure, a firearm gas-piston assembly for transferring firing force for reloading within an upper receiver includes a bolt carrier; a piston shroud configured for mounting to the upper receiver; and a piston connected with the bolt carrier. The piston may be arranged within the piston shroud to receive force from firing gas for reciprocating movement. The piston may be operable between an extended position and retracted position to drive reloading.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION OF THE DISCLOSED EMBODIMENTS

Figure 1:
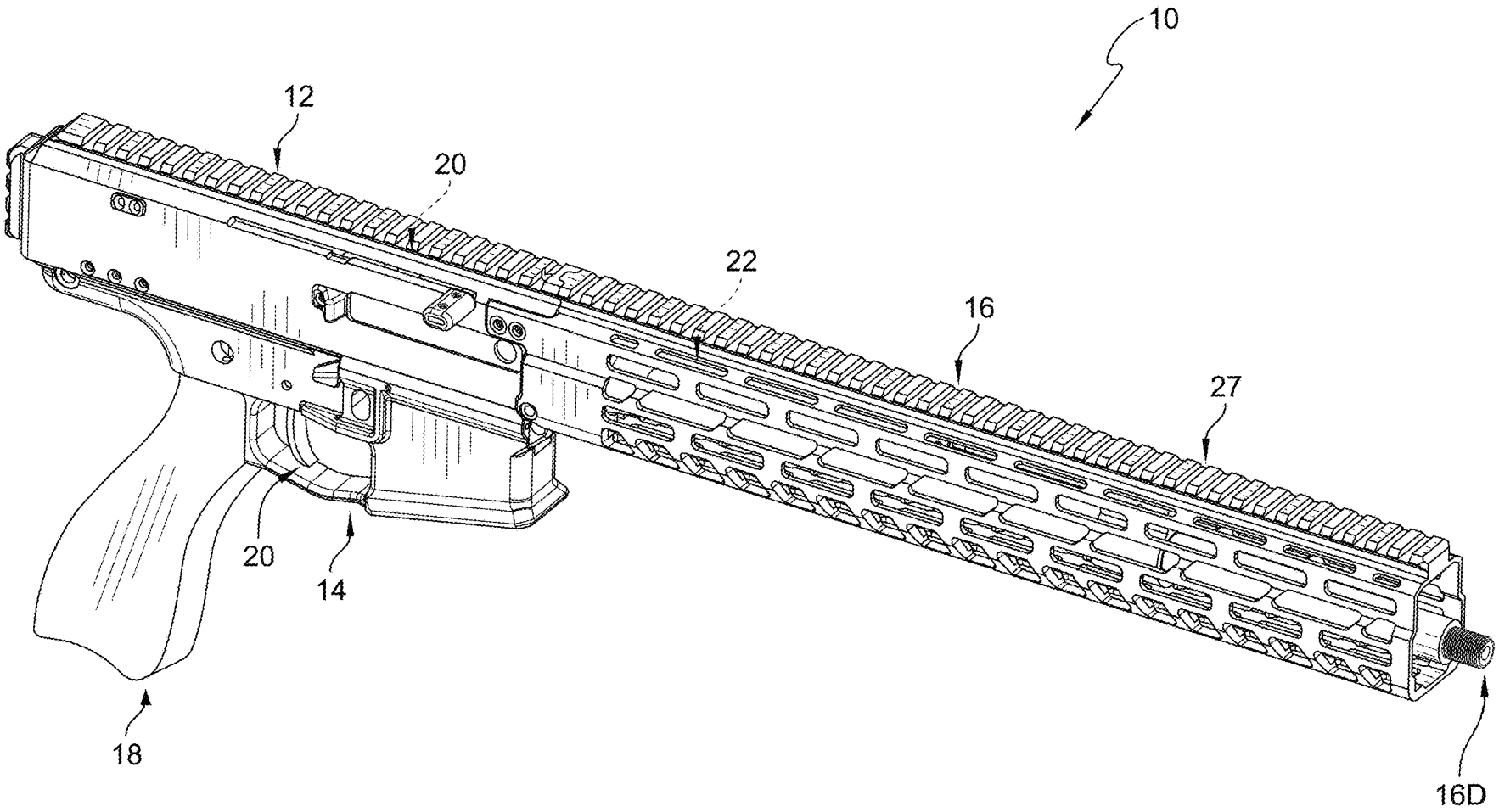
FIG. 1 is a perspective view of a firearm system having an upper receiver, a barrel (illustratively arranged within a handguard) coupled to the upper receiver, a bolt carrier coupled to the upper receiver for reciprocating motion relative to the upper receiver, and a gas-piston system configured to drive motion of the bolt carrier for reloading of the firearm system in accordance with aspects of the present disclosure.

As suggested in FIG. 1, a firearm system 10, in accordance with the present disclosure, is configured to fire projectiles and automatically (or semi-automatically) reload using a gas-piston system 22. The firearm system 10 includes an upper receiver 12, a lower receiver 14 coupled with the upper receiver 12, and a barrel 16 coupled with the upper receiver 12 and extending forward therefrom. The upper receiver 12 houses various components that are configured to discharge rounds (ammunition) start the firing/reloading cycle. The lower receiver 14 includes a rear handgrip 18 and a trigger 20 configured to be moved (activated) by a user to cause the components in the upper receiver to initiate the firing cycle. Upon discharge, a projectile is launched forward from the upper receiver 12 and passes through the barrel 16 before being exiting from the barrel 16 at a distal end 16D of the barrel 16 and propelled away from the firearm system 10. At least some of the firing gases produced by each round during the firing cycle also travel through the barrel 16 with the projectile. As discussed in additional detail herein, other portions of firing gases interact with the gas-piston system 22 to generate reloading.

Figure 2:
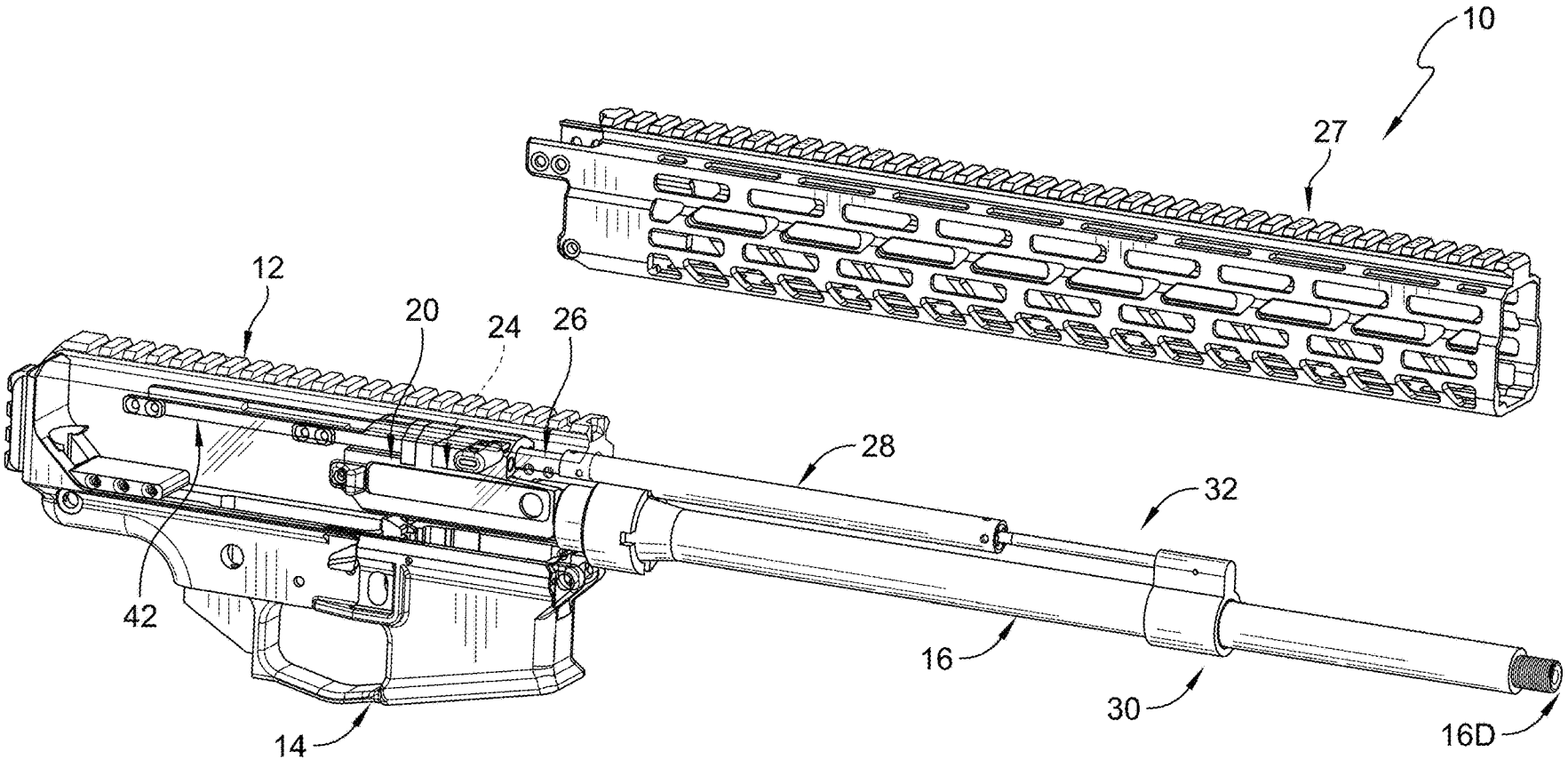
FIG. 2 is a partial exploded assembly view of the firearm system of FIG. 1 showing the front handguard of the firearm system removed and portions of the upper receiver shown in transparency for ease in viewing the barrel, the bolt carrier, and the gas-piston system in accordance with aspects of the present disclosure.

In the illustrative embodiment, the firearm system 10 includes a bolt carrier 20 and the gas-piston system 22 configured to utilize a portion of the firing gases from the barrel 16 during each firing cycle as suggested in FIGS. 1 and 2. The bolt carrier 20 is housed within the upper receiver 12 and is configured to reciprocate relative to the upper receiver 12 in response to each firing cycle. The gas-piston system 22 is coupled between the bolt carrier 20 and the barrel 16, and is configured to convert pressure from a portion of the firing gases produced during each firing cycle to cause the bolt carrier 20 to reciprocate within the upper receiver 12. As the bolt carrier 20 reciprocates rearward, a casing of the discharged projectile can be ejected from the upper receiver 12 and a new projectile can be reloaded into a firing chamber 24 formed by portions of the upper receiver 12 and the bolt carrier 20. Thus, the gas-piston system 22 is configured to transfer firing forces to the bolt carrier 20 for reloading the firearm system 10.

Referring to FIGS. 2-6, the gas-piston system 22 includes a piston 26 fixed with the bolt carrier 20, a piston shroud 28 fixed with the upper receiver 12, a gas block 30 connected with the barrel 16 and arranged to extend radially outward therefrom, and a gas tube 32 connected between to the gas block 30 and the piston shroud 28 to communicate firing gas.

In the illustrative embodiment, the piston 26 extends axially forward from the bolt carrier 20 and penetrates outside of the upper receiver 12 but within the piston shroud 28 in parallel relation to the barrel 16. The piston shroud 28 encloses the portion of the piston 26 which extends from the upper receiver 12, and extends axially forward from the upper receiver 12 to lie in parallel relation with the barrel 16 and the piston 26. The gas block 30 is located axially forward of the piston 26 and a free end 34 of the piston shroud 28. The gas tube 32 extends axially between the gas block 30 and the free end 34 of the piston shroud 28. The gas tube 32 illustratively extends parallel with the barrel 16 and is located axially forward of the piston 26. The firearm system 10 further includes a front grip 27 that is cantilevered from the upper receiver 12 and that surrounds the barrel 16 and the gas-piston system 22.

Figure 3:
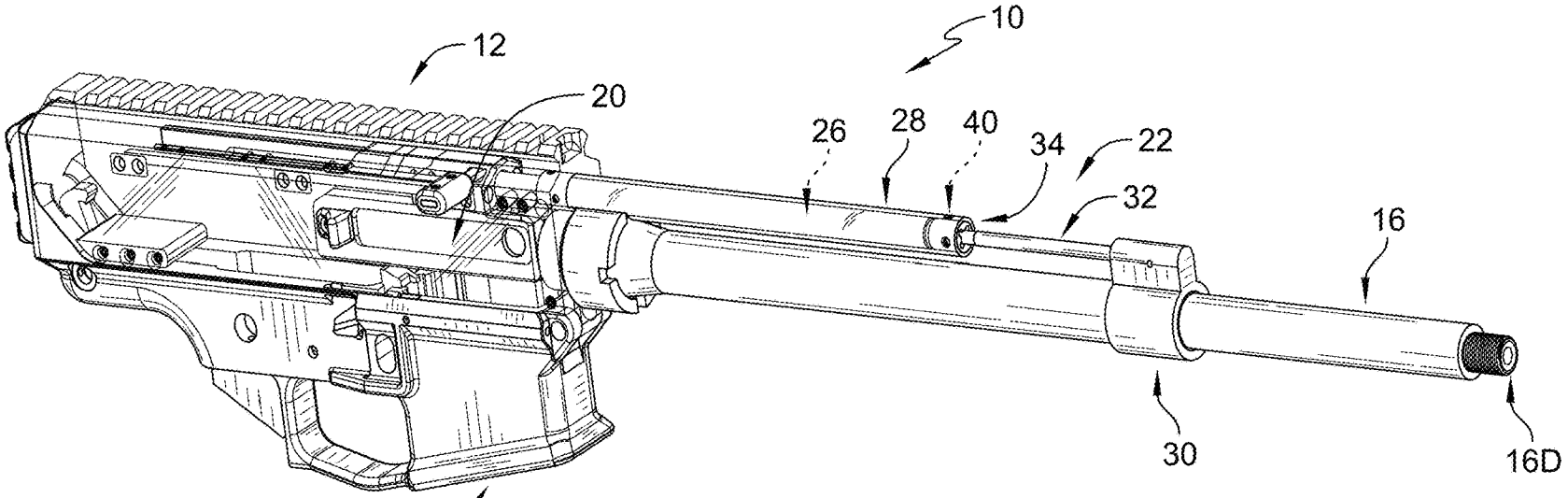
FIG. 3 is a perspective view similar to FIG. 2 showing the bolt carrier in an extended, firing position, for example, prior to firing a projectile from the firearm system, in accordance with aspects of the present disclosure.
Figure 4:
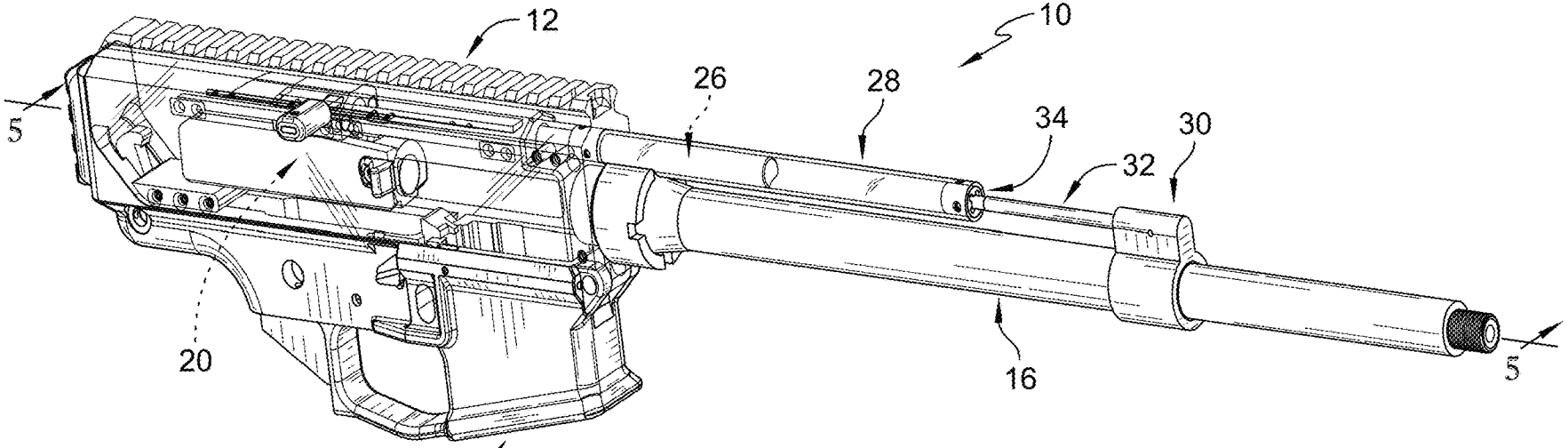
FIG. 4 is a perspective view similar to FIG. 3 showing the bolt carrier in a retracted, reload position, for example, once a projectile has been fired from the firearm system and the gas-piston system has driven the bolt carrier rearward, in accordance with aspects of the present disclosure.
Figure 5:
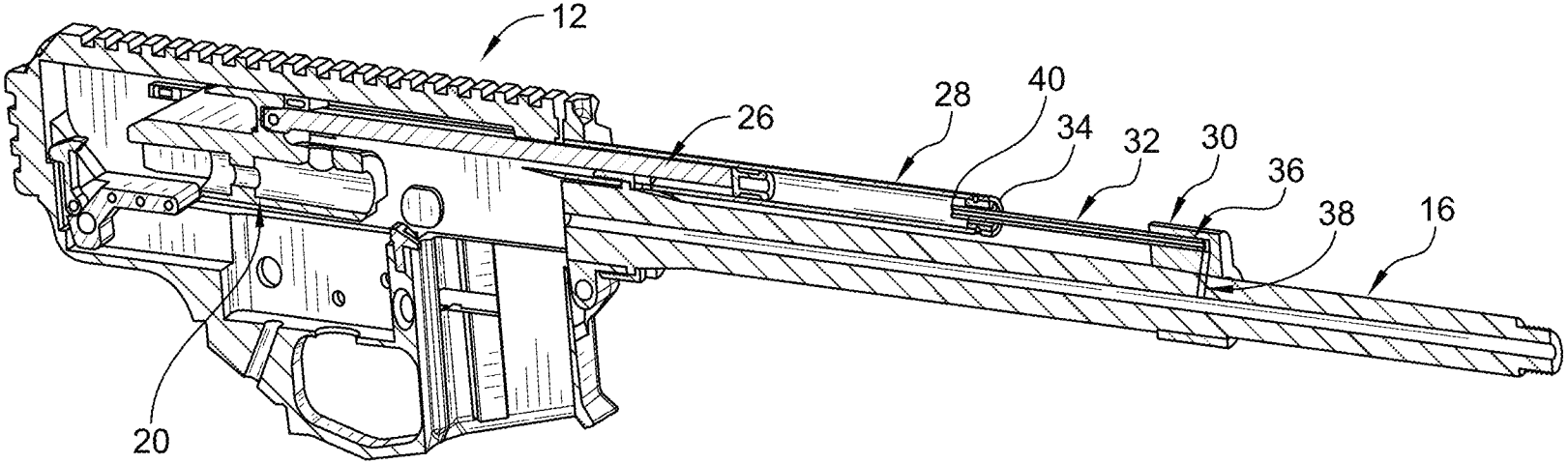
FIG. 5 is a cross section taken along line 5-5 in FIG. 4 showing the bolt carrier in the retracted position, in accordance with aspects of the present disclosure.

The piston 26 is operable between an extended position and retracted position. Under force from a portion of the firing gases from the barrel 16, the piston 26 is driven from the extended to the retracted position to cause reloading via the bolt carrier 20 as shown in FIGS. 3 and 4. Referring to FIG. 5, the gas block 30 and the barrel 16 are each formed to include corresponding passageways 36, 38 which communicate with one another to release a portion of the firing gases from the barrel 16 and through the gas block 30 to the gas tube 32 during a firing cycle.

In the illustrative embodiment, the gas tube 32 is coupled with the gas block 30 in fluid communication with the passageway 36 formed therein to direct the portion of the firing gases to the piston shroud 28. The portion of the firing gases exit through a rear end 40 of the gas tube 32 into the piston shroud 28 with the piston 26. The portion of the firing gases provide high pressure to cause the piston 26 to translate rearward through the piston shroud 28 from the extended position, as shown in FIG. 3, to the retracted position, as shown in FIGS. 4 and 5. Coincidently, the piston 26 drives the bolt carrier 20 to translate rearward away from the barrel 16 and the piston shroud 28. The upper receiver 12 includes one or more biasing elements (i.e., a compression spring) to bias the bolt carrier 20 and the piston 26 forward towards the extended position. Upon relief of the gas pressure within the piston shroud 28, the bolt carrier 20 and piston 26 are returned to the extended position under biasing force. The piston shroud 28 is configured to guide movement of the piston 26 between the extended and retracted positions. The upper receiver 12 may further include one or more rails 42 (shown in FIG. 10) configured to support the bolt carrier 20 therein and guide movement of the bolt carrier 20 between the extended and retracted positions.

Figure 6:
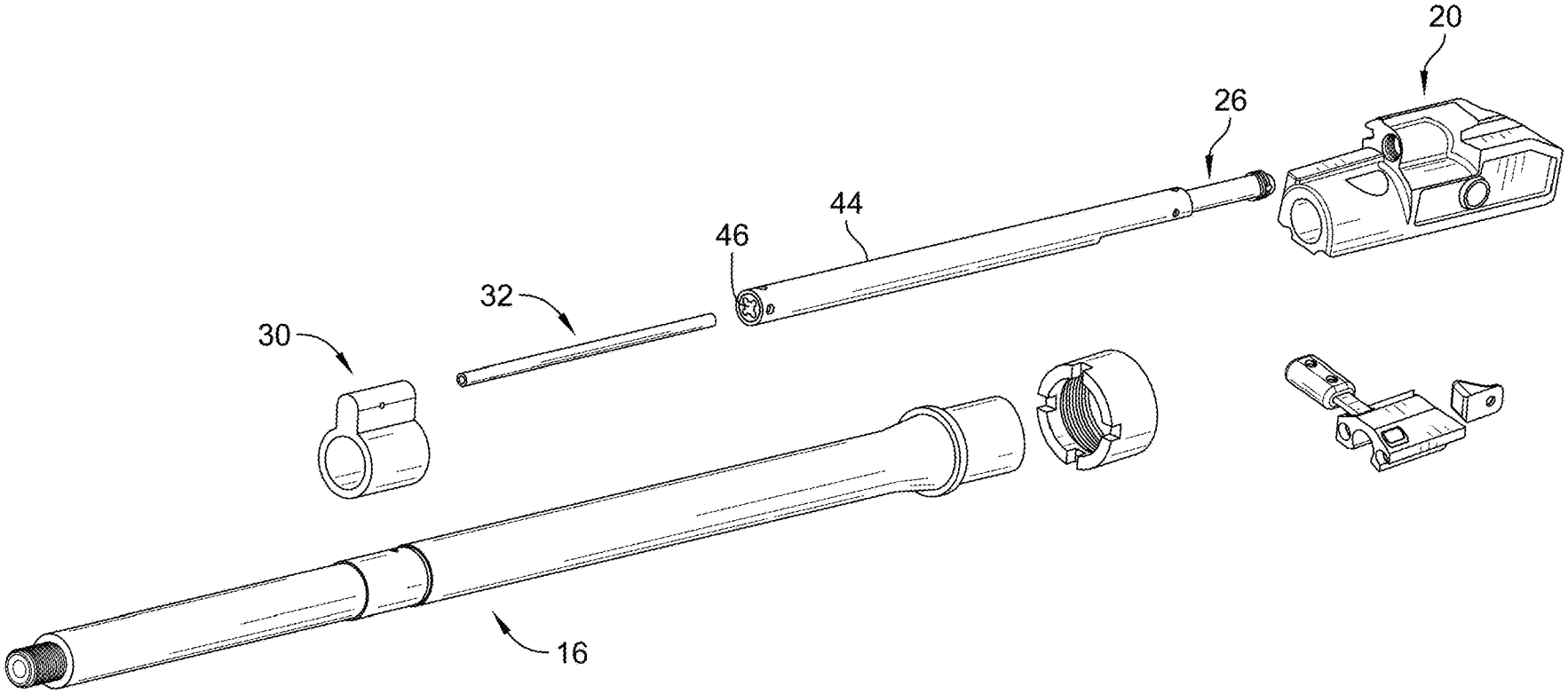
FIG. 6 is an exploded assembly view of a portion of the firearm system of FIG. 1 showing that the gas-piston system includes a piston configured to be fixed to the bolt carrier for movement therewith, a piston shroud configured to be fixed to the upper receiver, a gas block configured to be fixed to the barrel and arranged to extend radially therefrom, and a gas tube arranged to extend axially between the gas block and the piston shroud such that gases are directed from the barrel, through the gas block, axially aft through the gas tube, and into the piston shroud to displace the piston and the bolt carrier rearward for reloading of the firearm system in accordance with aspects of the present disclosure.
Figure 7:
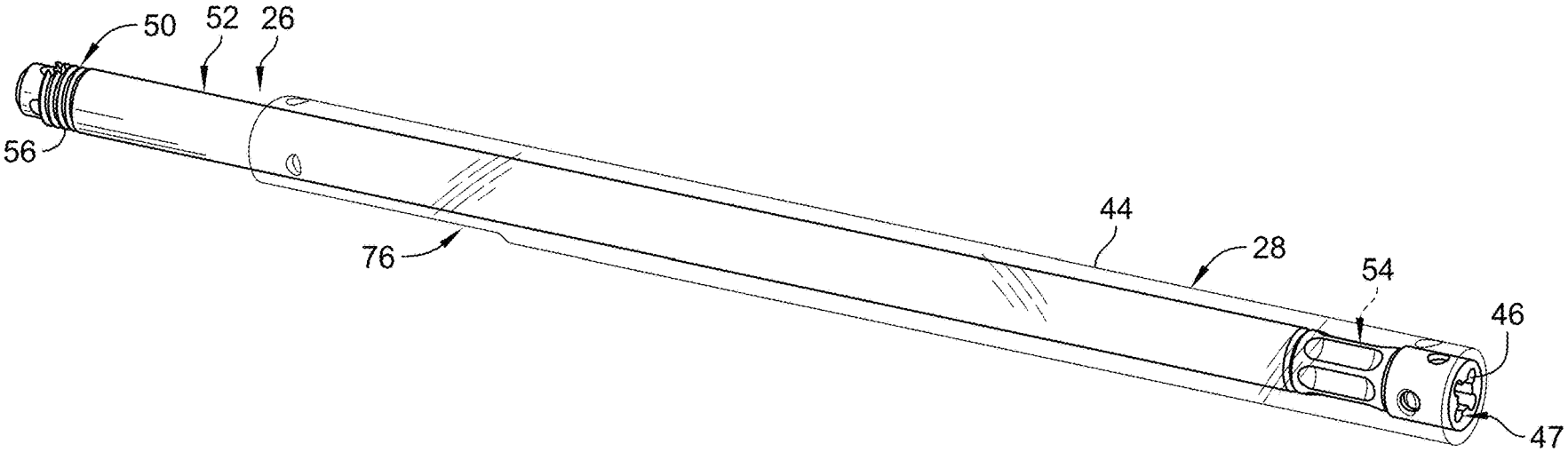
FIG. 7 is an enlarged perspective view of the piston and the piston shroud from FIG. 3 assembled and with the piston shroud made transparent to show that the piston is sized to be received in the piston shroud and further showing that the gas-piston system further includes a piston extension also received within the piston shroud and positioned at a forward end of the piston to translate with the piston and the bolt carrier under interaction with the gases from the gas tube, in accordance with aspects of the present disclosure.

The piston shroud 28 is cantilevered from a front end of the upper receiver as shown in FIGS. 2-5. Referring to FIGS. 5-7, the piston shroud 28 includes shroud tube 44 that extends circumferentially around the piston 26, and a gas tube receiver 46 arranged at the free end 34 of the piston shroud 28 for interfacing between the firing gas and the piston. In the illustrative embodiment, the shroud tube 44 has an internal diameter sized to receive the gas tube receiver 46 at the free end 34. The gas tube receiver 46 is configured for interfacing with the internal diameter of the shroud tube 44 and the gas tube 32 to receive the portion of the firing gas therefrom for communication into the piston shroud 28. The gas tube receiver 46 is formed to include a X-shaped opening 47. The X-shaped opening 47 allows reception of the gas tube therein for communication of gases into the piston shroud 28. One or more fasteners may be used to fix the gas tube receiver 46 to the free end 34 of the shroud tube 44.

The barrel 16 is configured to be free-floating to reduce effects on the movement of the barrel under firing. Such intense firing movement characteristics such as vibrations and frequency response mechanisms caused during firing can be improved (or indirect influence onto their natural motion can be avoided) by free-floating design in which the barrel and handgrip are each independently cantilevered from the upper receiver to avoid interference with their movements under firing. Similarly, the gas-piston system 22 is illustratively formed with free-floating connection with the barrel 16 to block against detrimental impact to the barrel's firing movement characteristics. In the illustratively embodiment the gas tube 32 is freely received by the gas tube receiver 46 for fluid connection between the piston shroud 28 with the barrel 16 to communicate firing gas to the piston shroud 28 without undue restraint imposed onto (or by) the barrel 16. The free reception between the gas tube receiver 46 and the gas tube 32 illustratively permits limited sliding and/or vibrational movement therebetween, while facilitating communication of firing gas into the piston shroud 28. Accordingly, the barrel 16 can communicate firing gas to the piston shroud 28 with freedom for independent, cantilevered barrel dynamics under firing-reducing impacts to the firing movement which could be inhibited by restrictive connections.

Traditional piston-style reload firearms, such as the AK-47 (or Avtomat Kalashnikova) and similar, can rigidly restrain components, including the barrel by the piston system which can be rigidly anchored with the barrel and receiver. Such constraints can dramatically affect firing performance, including by accuracy, precision, and/or mechanical wear on the barrel itself. Moreover, traditional gas-operated reload firearms, such as the AR-15 and similar, introduce firing gas into the upper receiver which can leave considerable soiling amid precision parts, which can lead to jamming and/or wear, and/or can require significant maintenance/cleaning under normal operation.

In the illustrative embodiment, the rear end 40 of the gas tube 32 is located axially rearward of the free end 34 of the shroud tube 44 to locate the rear end 40 of the gas tube 32 axially between at least a portion of the piston 26 and the free end 34 of the shroud tube 44. The rear end 40 of the gas tube 32 is freely received in the gas tube receiver 46 to allow translation between the piston shroud 28 and the gas tube 32 as the barrel 16 lengthens during use. Accordingly, a distance between the free end 34 of the shroud tube 44 and the rear end 40 of the gas tube 32 may decrease as the barrel 16 thermal expands. In some embodiments, a front end 48 of the gas tube 32, opposite the rear end 40, may be received in the gas block 30 with an interface that allows translation of the gas tube 32 relative to the gas block 30.

The gas tube 32 is arranged not to enter the upper receiver 12 as shown in FIGS. 2-5. Rather, the rear end 40 of the gas tube 32 is positioned axially forward of the upper receiver 12. In illustrative embodiments, a distance between the rear end 40 of the gas tube 32 and the upper receiver 12 is greater than a distance between the rear end 40 of the gas tube 32 and the gas block 30.

Figure 8:
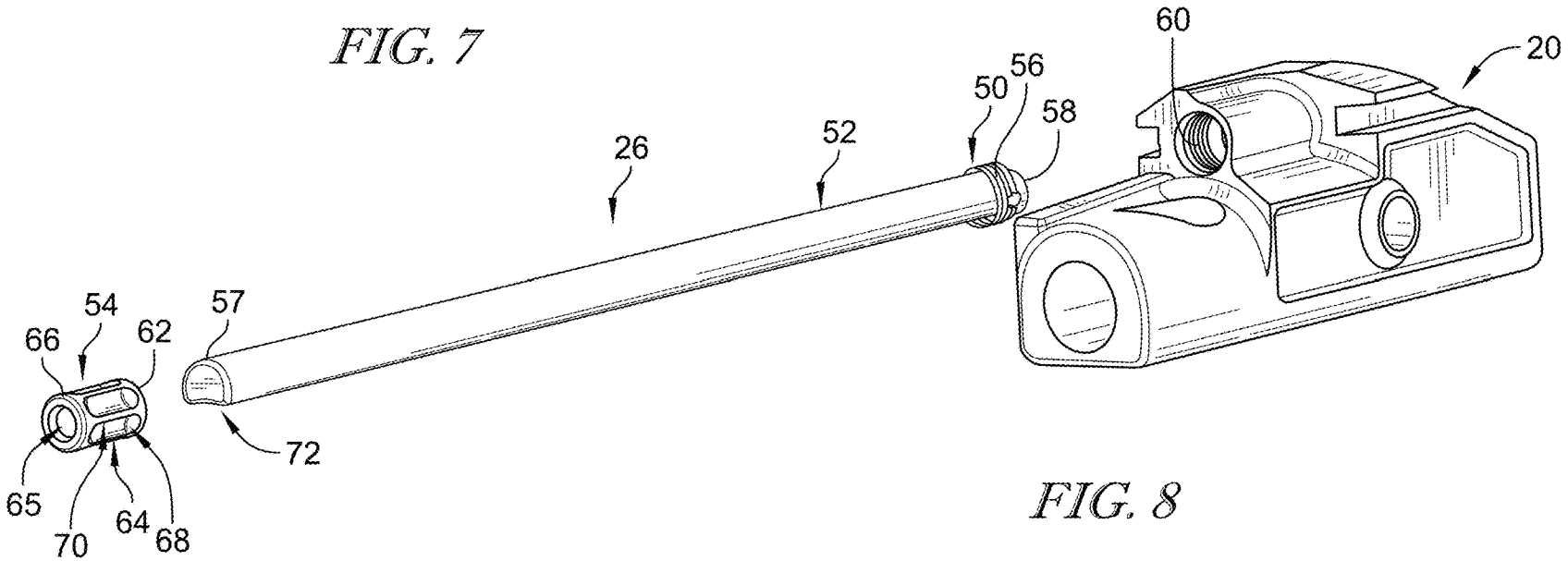
FIG. 8 is an exploded assembly view of a portion of the gas-piston system including, from left to right, the piston extension arranged to abut a distal end of the piston, the piston including threads at a proximal end thereof to fix the piston with the bolt carrier, and the bolt carrier being formed to include a threaded opening to receive the proximal end of the piston in accordance with aspects of the present disclosure.

The piston 26 extends from the bolt carrier 20 out from the upper receiver 12 and into the piston shroud 28 as shown in FIGS. 2-5. Referring to FIG. 8, the piston 26 includes a piston base 50 configured to couple with the bolt carrier 20, a piston rod 52 coupled with the piston base 50, and a piston extension 54 coupled with a distal end 57 of the piston rod 52 as shown in FIGS. 7 and 8. The piston base 50 illustratively includes external threading 56 formed on a rear end 58 of the piston rod 52. The piston base 50 is illustratively configured to be threaded onto corresponding internal threads 60 formed in the bolt carrier 20 to fix the piston rod 52 to the bolt carrier 20. In some embodiments, the piston 26 may be coupled with the carrier by other suitable connections, such as by fasteners and/or weld. The piston rod 52 extends axially forward away from the bolt carrier 20 and out from the upper receiver 12 within the shroud tube 44 of the piston shroud 28. The piston extension 54 is slidably arranged within the shroud tube 44 of the piston shroud 28 abutting the piston 26. The piston extension 54 is positioned between the distal end 57 of the piston rod 52 and the free end 34 of the piston shroud 28 to receive force from firing gas entering the piston shroud 28. The forces from the firing gases are imparted on the piston extension 54 for transmission to the piston rod 52 to drive the piston 26 and the bolt carrier 20 to the retracted position.

The piston extension 54 is formed distinctly from the piston rod 52 and has close tolerancing with an interior wall of the shroud tube 44 to block against passage of firing gas beyond the piston extension 54 toward the piston rod 52. The piston extension 54 includes a disc-shaped base 62, a sidewall 64 extending forward from the disc-shaped base 62, and a distal ring 66 coupled to a forward end of the sidewall 64 as shown in FIG. 8. The disc-shaped base 62 is configured to abut against the distal end 57 of the piston rod 52 and is formed without any openings to block passage of firing gases past the disc-shaped base 62. On the end of the distal ring 66, the piston extension includes a depression 65 configured to receive engagement with firing gases. The distal ring 66 is configured to engage with the interior walls of the shroud tube 44 to provide the close tolerancing between the distal ring 66 and the shroud tube 44. In some embodiments, the disc-shaped base 62 and/or side wall 64 may engage with the interior walls of the shroud tube 44 to provide close tolerancing between the extension and the shroud tube 44.

In the illustrative embodiment, the sidewall 64 is formed to include a plurality of indentations 68 and ribs 70 between each indentation 68 as shown in FIG. 8. The plurality of indentations 68 are formed in an exterior surface of the sidewall 64 opposite the hollow interior 65. The indentations 68 are configured to reduce friction between the piston extension 54 and the piston shroud 28 and/or allow for thermal growth of the piston extension 54. The ribs 70 can increase stiffness and/or durability of the sidewall 64.

Figure 9:
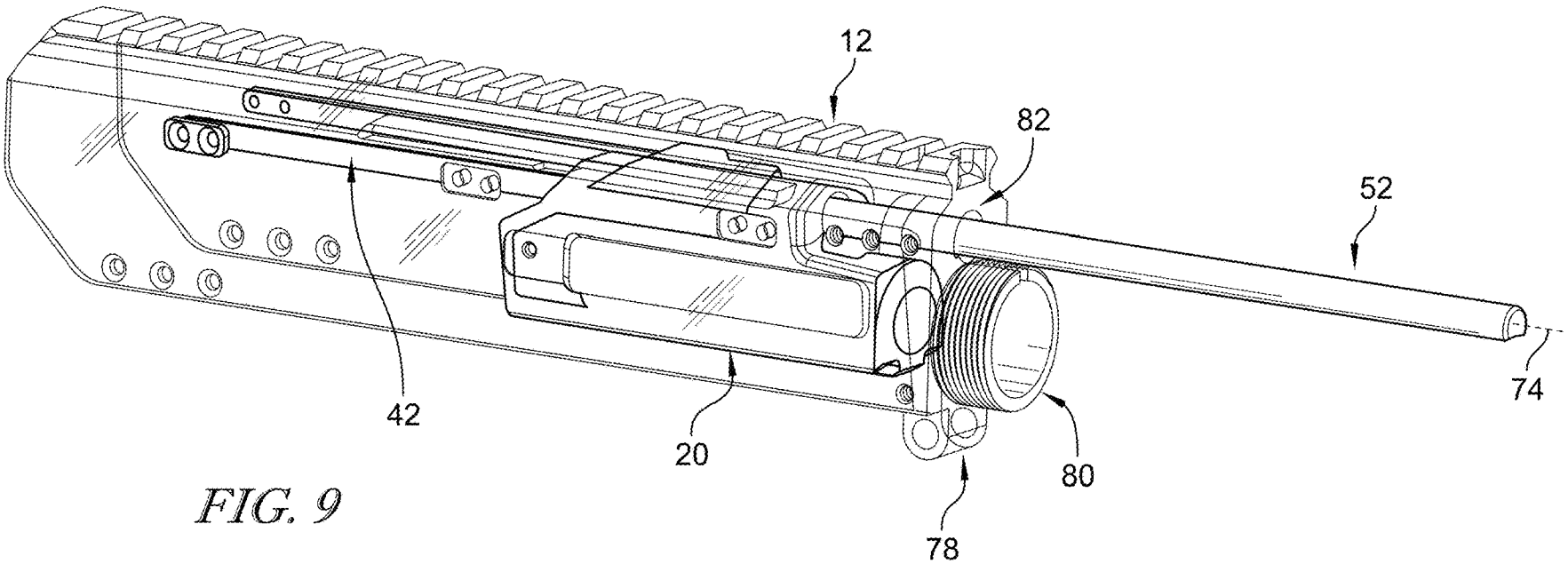
FIG. 9 is a perspective view of a portion of the firearm system from FIG. 1 showing the upper receiver with transparency, the bolt carrier arranged to lie within an interior of the upper receiver, and the piston attached to the bolt carrier and arranged to extend forward from and out of the interior of the upper receiver such that the distal end of the piston is spaced apart from the upper receiver in accordance with aspects of the present disclosure.

Referring to FIGS. 8 and 9, portions of the gas-piston system 22 are formed to provide a low-profile gas-piston system. The piston 26 is formed with a low profile cross-section taken along a longitudinal direction parallel with the barrel 16. For example, the piston rod 52 is formed to include a cutout 72 at a lower end of the piston rod 52 facing toward the barrel 16. The cross-section is shaped as a circular portion reduced from circular to provide the cutout 72 and allow reduced height-over-bore. The cutout 72 is configured to provide spacing to position a central axis 74 of the piston rod 52 particularly close to the barrel 16. In the illustrative embodiment, the cutout 72 extends from the distal end 57 of the piston rod 52 to the piston base 50, although in other embodiments, the cutout 72 may only extend partway along a length of the piston rod 52. The shroud tube 44 of the piston shroud 28 may also be formed to include a cutout 76 at a lower end of the shroud tube 44 facing toward the barrel 16.

Figure 10:
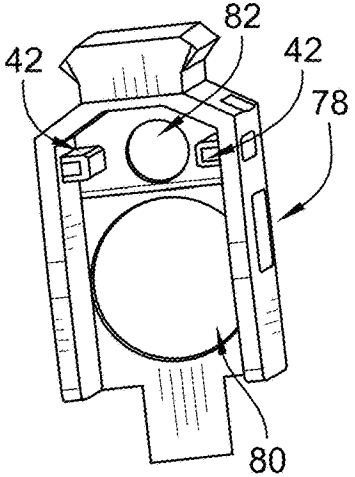
FIG. 10 is a perspective rear view of a portion of the upper receiver showing that the upper receiver is formed to include a first opening that is coincident with the barrel and a second opening positioned above the first opening and sized to receive the piston in accordance with aspects of the present disclosure.
Figure 11:
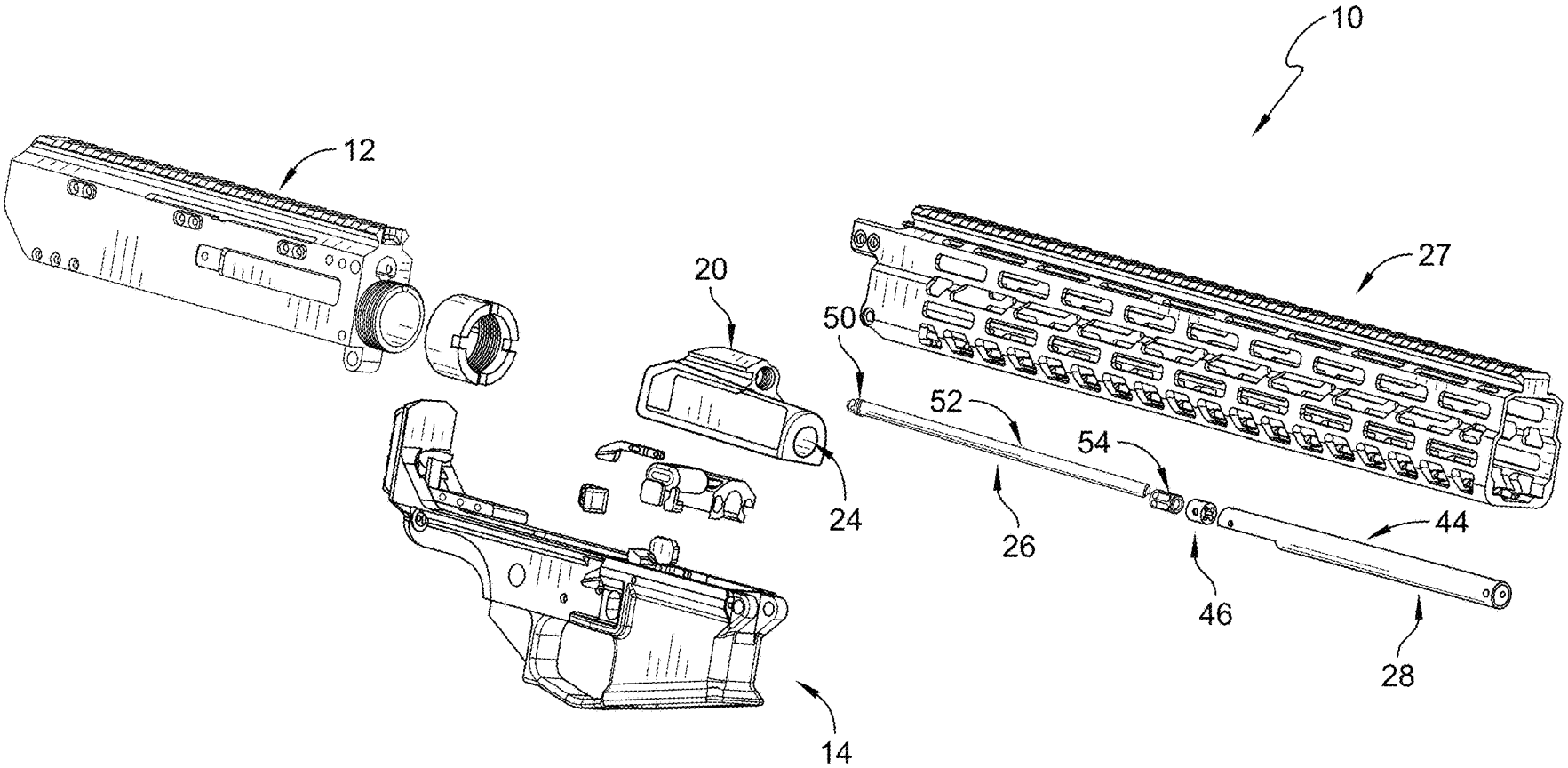
FIG. 11 is another exploded assembly view of the firearm system in accordance with aspects of the present disclosure.

The upper receiver 12 further includes a barrel mount 78 configured to attach the barrel 16 to the upper receiver 12 as shown in FIGS. 9 and 10. The barrel mount 78 is formed to include a barrel opening 80 and a piston opening 82 above the barrel opening 80. The barrel opening 80 illustratively has a larger diameter than the piston opening 82. The barrel opening 80 is aligned with the firing chamber 24 of the bold carrier 20 while the piston opening 82 is aligned with the rails 42 that support the bolt carrier 20 for movement back and forth between the extended and retracted positions.

Figure 12:
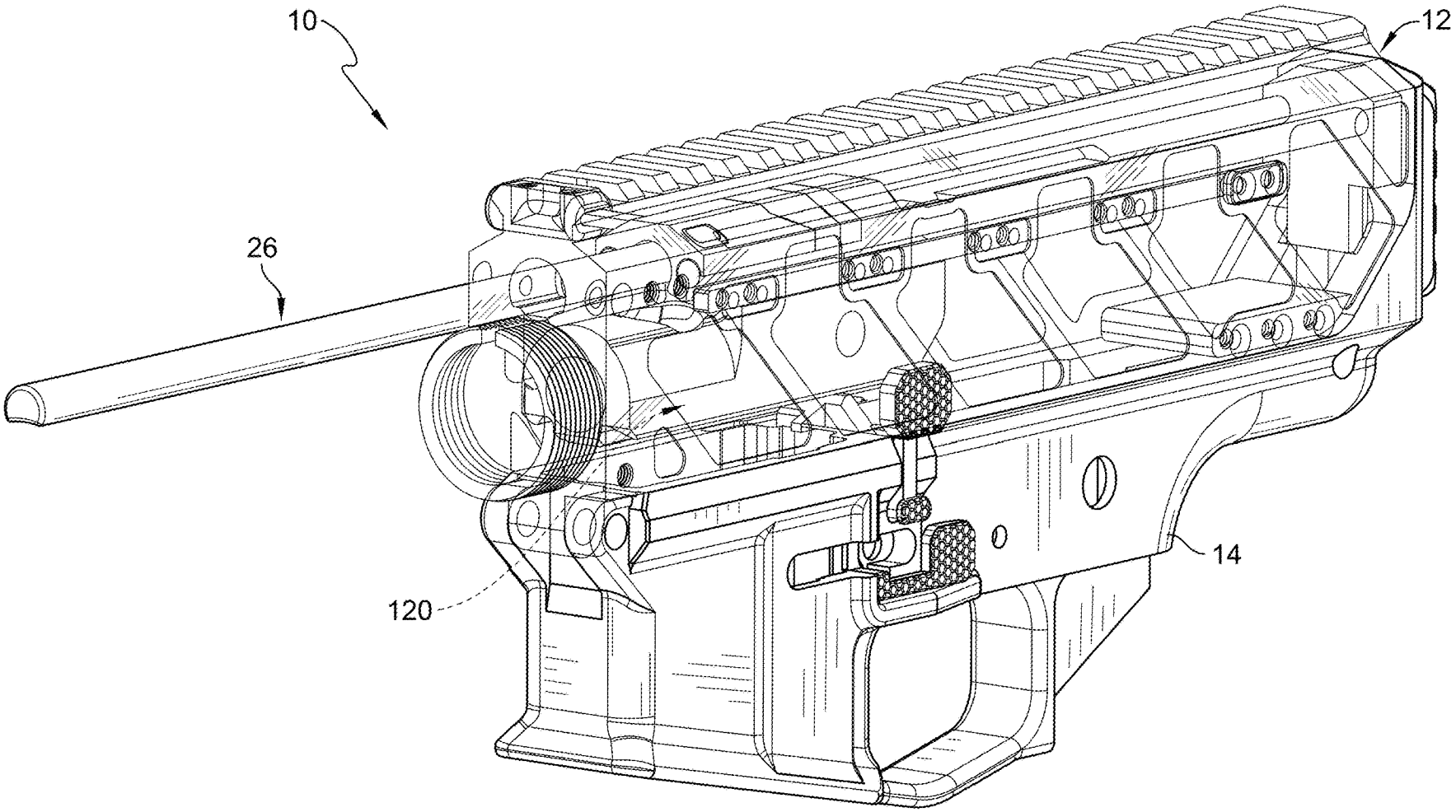
FIG. 12 is a perspective view of a portion of the firearm system from FIG. 1, similar to FIG. 9, showing the upper receiver with transparency, but showing that another aspect of a bolt carrier is arranged to engage recoil guide rods for guiding recoil action, and a cam pin guide rail for assisting operation of the cam pin (not shown)
Figure 13:
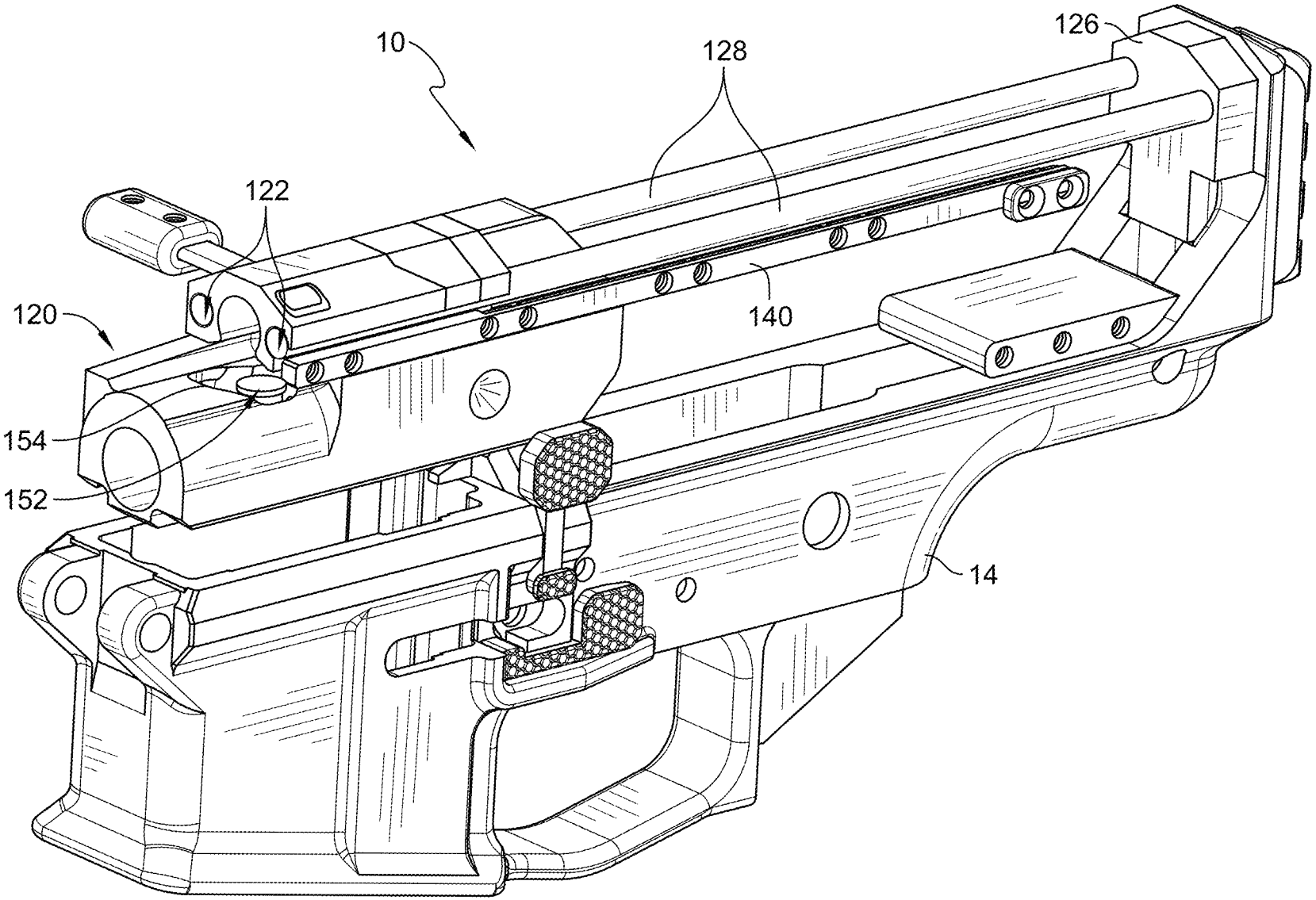
FIG. 13 is the perspective view of the portion of the firearm system from FIG. 12 showing the upper receiver and piston removed for ease of viewing, and showing that the recoil guide rods engage with the bolt carrier and the guide rail is positioned in correspondence with the cam pin slot.

Referring now to FIG. 12, another embodiment of a bolt carrier 120 is shown in conjunction with the firearm system 10. The bolt carrier 120 is generally similar to the bolt carrier 20, and the disclosure concerning bolt carrier 20 applies equally to bolt carrier 120, except as otherwise indicated by specific disclosure of bolt carrier 120. As shown in FIG. 13, the bolt carrier 120 illustratively includes a pair of guide holes 122 each arranged to receive a recoil guide rod 124 therethrough for guiding motion of the bolt carrier 120.

Figure 14:
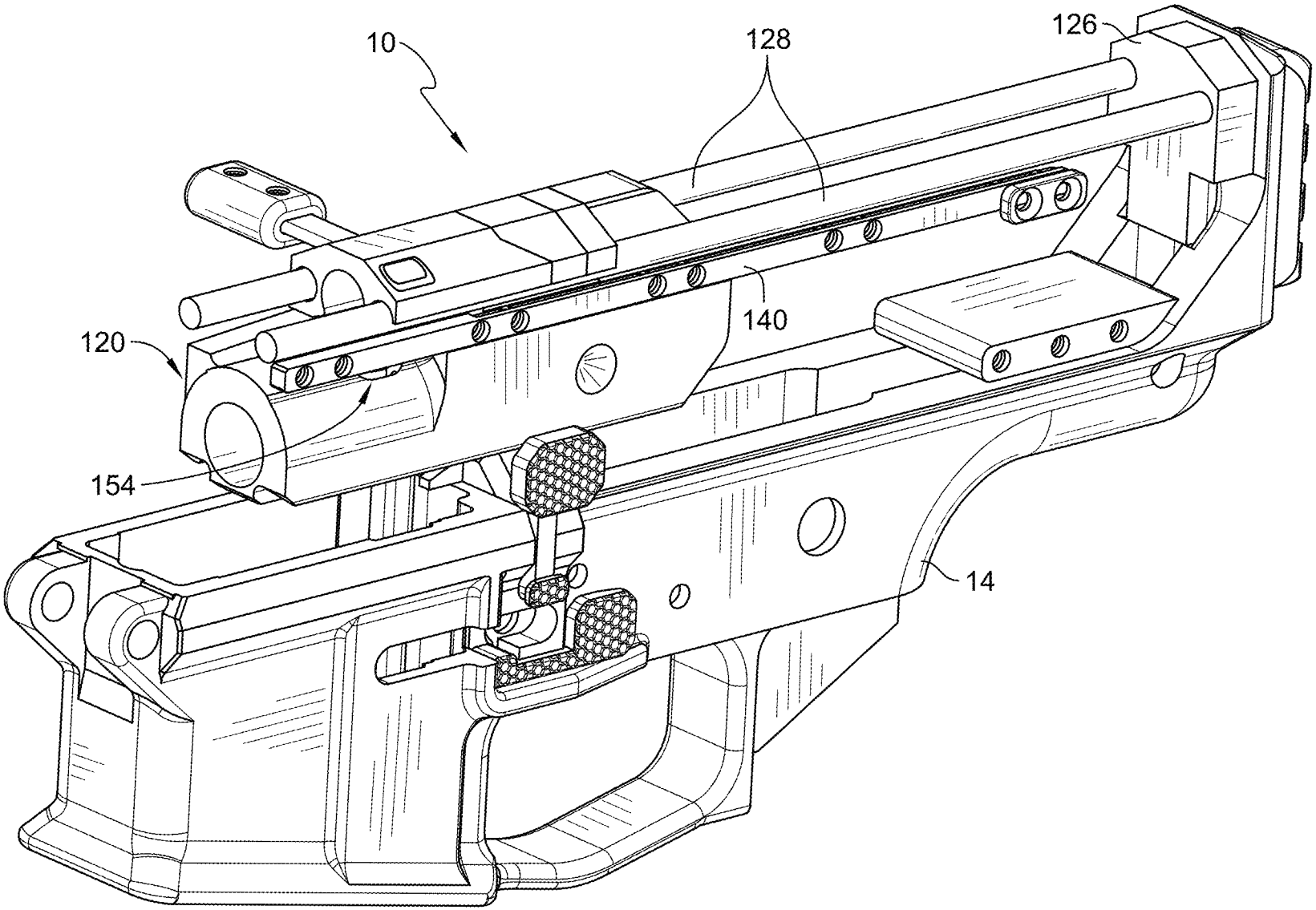
FIG. 14 is the perspective view of the portion of the firearm system from FIGS. 12 and 13, showing the bolt carrier translated backward away from the barrel, for example, under force of firing, and showing that the guide rail partially covers the cam pin slot to block against premature rotation of the bolt.

Each of the recoil guide rods 124 extends from the lower receiver 14. The recoil guide rods 124 each illustratively connect with a guide rod base 126 of the lower receiver 14, and extend cantilevered therefrom. The guide rods 124 provide a rigid track to guide smooth recoil motion of the bolt carrier 120 under firing. Referring to FIGS. 13 and 14, the bolt carrier 120 illustratively slides rearward (towards the guide rod base 126) under firing force, as suggested in FIG. 14, and returns under recoil by the force of one or more recoil springs (not shown) which may be formed as coiled compression springs mounted over the recoil guide rails 124 for resilient compression between the bolt carrier 120 and the lower receiver 14.

Still referring to FIGS. 13 and 14, a guide rail 150 is illustratively arranged to engage with a cam pin 152 that extends through a cam pin slot defined by the bolt carrier 120. The cam pin connects with the bolt (not shown) to provide timed rotational movement thereof, according to travel of the cam pin 152 along the cam pin slot 154 which is extends angularly along the recoil direction of the bolt carrier 120 to induce cam-style rotation of the bolt via the cam pin 152.

Figure 15:
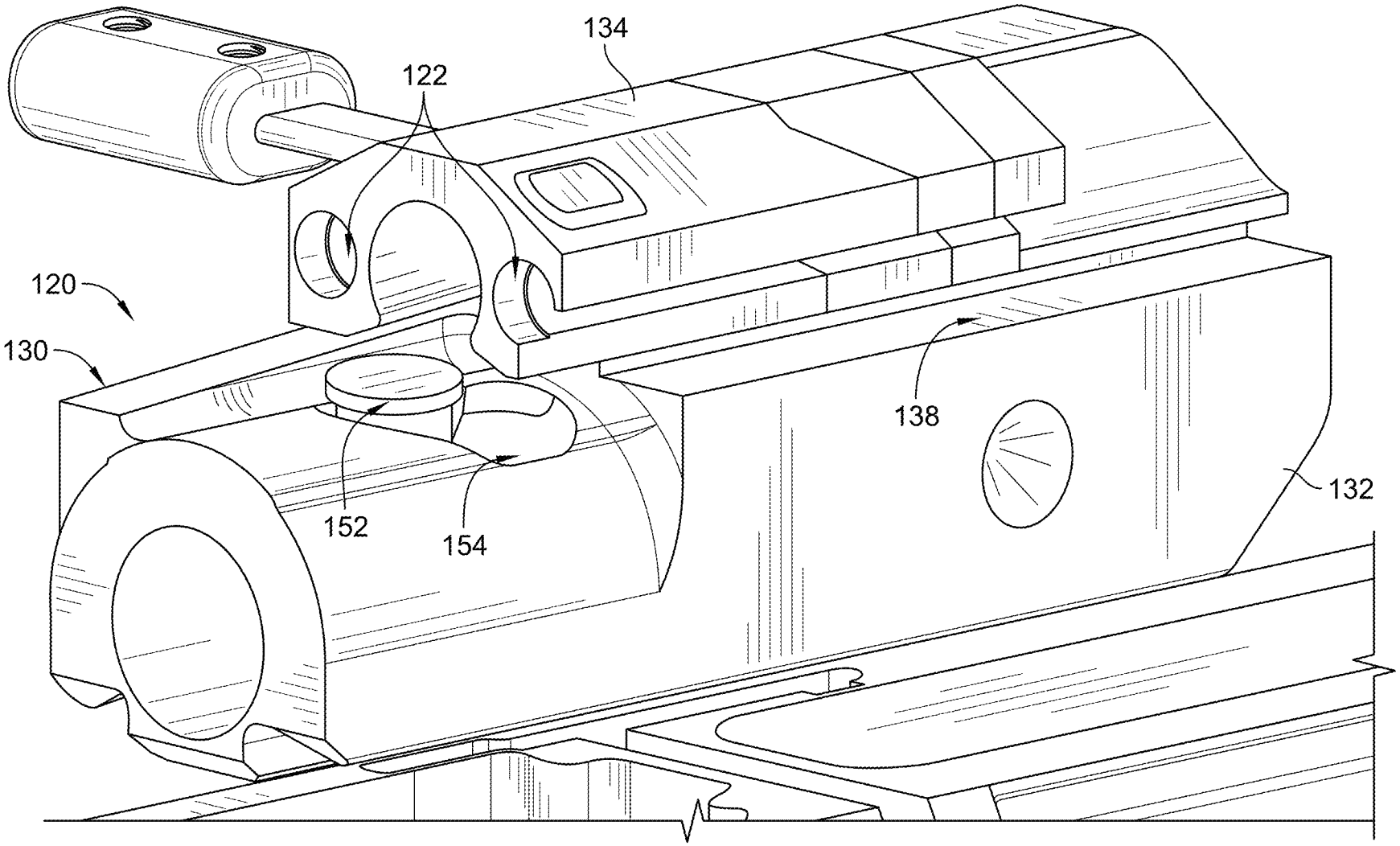
FIG. 15 is perspective view of the bolt carrier of the firearm system of FIGS. 12-14 showing that a rail slot is defined to allow access of the guide rail to cover the cam pin slot.

Referring to FIG. 15, the bolt carrier 120 includes a body 130 having a base 132, a charging portion 134, and a guide plate 136. The guide holes 122 are each defined through the guide plate 136 and the charging portion 134. A guide rail slot 138 is illustratively defined in the body 130 to allow a guide rail 140 to extend for access to the cam pin slot 154.

The guide rail 140 is illustratively secured within the upper receiver 12 in position for assisting operation of the cam pin 152. The guide rail 140 is illustratively attached to an interior wall of the upper receiver 14, similar to guide rail 42, however the guide rail 140 is arranged to engage the cam pin 152 rather than to guide movement of the bolt carrier 120. When the bolt carrier 120 is moved rearward along the guide rods 124 (as suggested in FIG. 14) under force of firing, the cam pin slot 154 is partially covered by the guide rail 140 to block against untimely (premature) rotation of the bolt. Accordingly, proper timing of bolt rotation can be insured.

Although certain embodiments have been described and illustrated in exemplary forms with a certain degree of particularity, it is noted that the description and illustrations have been made by way of example only. Numerous changes in the details of construction, combination, and arrangement of parts and operations may be made. Accordingly, such changes are intended to be included within the scope of the disclosure, the protected scope of which is defined by the claims.

What is claimed is:

1. A firearm system, comprising: an upper receiver, a barrel mounted to the upper receiver; a bolt carrier arranged within the upper receiver for reciprocation; and a gas-piston system for transferring firing force to the bolt carrier for reloading, wherein the gas-piston system includes a piston shroud mounted to the upper receiver and a piston fixedly coupled with the bolt carrier, wherein the piston is arranged within the piston shroud to receive force from firing gas from the barrel for reciprocating movement, the piston operable between an extended position and retracted position to drive reloading via the bolt carrier, wherein the piston shroud is cantilevered from the upper receiver.

2. The firearm system of claim 1, wherein the piston shroud includes a gas tube receiver arranged at a free end of the piston shroud.

3. The firearm system of claim 2, wherein the gas tube receiver is configured for interfacing with a gas tube that is fluidly connected with the barrel to receive firing gas therefrom for communication into the piston shroud.

4. The firearm system of claim 3, wherein the gas tube is freely received by the gas tube receiver for fluid connection between the piston shroud with the barrel to communicate firing gas without restraint of the barrel.

5. The firearm system of claim 3, wherein the barrel includes a gas block extending radially therefrom for connection with the gas tube to communicate firing gas.

6. The firearm system of claim 2, wherein the gas tube is arranged not to enter the upper receiver.

7. The firearm system of claim 1, wherein the barrel is configured for free-floating.

8. The firearm system of claim 7, wherein the barrel is cantilevered from the upper receiver and is configured for communication of firing gas from the barrel to the piston shroud with freedom for independent, cantilevered barrel dynamics under firing.

9. The firearm system of claim 1, wherein the piston extends from the bolt carrier out from the upper receiver and into the piston shroud.

10. The firearm system of claim 1, wherein the piston includes a piston extension arranged within the piston shroud and positioned between the piston and an end of the piston shroud to receive force from firing gas to drive the piston extension for movement for transmission to the piston.

11. The firearm system of claim 10, wherein the piston extension is configured for reciprocating movement within the piston shroud having close tolerancing with an inner cavity wall of the piston shroud to block against passage of firing gas beyond the piston extension.

12. The firearm system of claim 10, wherein the piston extension is formed distinctly from the piston, and each of the piston extension and piston are arranged for reciprocating motion within the piston shroud.

13. The firearm system of claim 1, wherein the piston is formed with a low profile cross-section taken along a longitudinal direction parallel with the barrel.

14. The firearm system of claim 13, wherein the cross-section is shaped as a circular portion that reduces in circumference to allow reduced height-over-bore.

15. The firearm system of claim 13, wherein the cross-section is shaped as a circular segment.

16. The firearm system of claim 13, wherein the piston is formed to have a full-profile cross-section at one end for connection with the bolt carrier, and the low profile cross-section is formed on an extension portion projecting away from the bolt carrier for arrangement within the piston shroud.

17. The firearm system of claim 1, further comprising a lower receiver coupled with the upper receiver to form a firearm.

18. A firearm, comprising: a receiver including an upper receiver and a lower receiver; a barrel mounted to the upper receiver; a bolt carrier arranged within the upper receiver for reciprocation; and a gas-piston system for transferring firing force to the bolt carrier for reloading, wherein the gas-piston system includes a piston shroud mounted to the upper receiver and a piston fixedly coupled with the bolt carrier, wherein the piston is arranged within the piston shroud to receive force from firing gas from the barrel for reciprocating movement, the piston operable between an extended position and retracted position to drive reloading via the bolt carrier, wherein the piston shroud is cantilevered from the upper receiver.

19. A firearm gas-piston assembly for transferring firing force for reloading within an upper receiver, comprising: a bolt carrier; a piston shroud configured for mounting to the upper receiver; and a piston fixedly coupled with the bolt carrier, wherein the piston is arranged within the piston shroud to receive force from firing gas for reciprocating movement, the piston operable between an extended position and retracted position to drive reloading, wherein the piston shroud is cantilevered from the upper receiver.

* * * * *